US006817493B1

(12) United States Patent
Parsons et al.

(10) Patent No.: US 6,817,493 B1
(45) Date of Patent: Nov. 16, 2004

(54) SPRAY NOZZLE

(75) Inventors: William G. Parsons, Racine, WI (US); Gary A. Hurtienne, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 10/646,198

(22) Filed: Aug. 22, 2003

(51) Int. Cl.[7] ..... B65D 83/00

(52) U.S. Cl. ..... 222/402.1; 222/330; 222/402.13; 239/548; 239/552

(58) Field of Search ..... 222/402.1, 1, 402.13, 222/330, 575; 239/553, 556–557, 553.5, 548, 552

(56) References Cited

U.S. PATENT DOCUMENTS

| | | | | | |
|---|---|---|---|---|---|
| 3,198,437 | A | | 8/1965 | Faglie | |
| 3,406,913 | A | * | 10/1968 | Frangos | 239/543 |
| 3,568,933 | A | * | 3/1971 | Macguire-Cooper | 239/543 |
| 3,628,733 | A | * | 12/1971 | Kahn | 239/337 |
| 3,724,763 | A | * | 4/1973 | Braun | 239/490 |
| 3,767,125 | A | * | 10/1973 | Gehres et al. | 239/552 |
| 4,185,777 | A | * | 1/1980 | Bauer | 239/394 |
| 4,277,004 | A | * | 7/1981 | Barlics | 222/402.14 |
| 4,790,985 | A | * | 12/1988 | Nelson | 423/644 |
| 4,902,281 | A | | 2/1990 | Avoy | |
| 5,005,736 | A | | 4/1991 | Portas | |
| 5,068,099 | A | | 11/1991 | Sramek | |
| 5,080,286 | A | * | 1/1992 | Morrison | 239/533.13 |
| 5,088,649 | A | * | 2/1992 | Hanson et al. | 239/329 |
| 5,249,747 | A | * | 10/1993 | Hanson et al. | 239/373 |
| 5,516,045 | A | * | 5/1996 | Baudin | 239/337 |
| 5,730,332 | A | * | 3/1998 | Zimmerhackel | 222/148 |
| 5,785,256 | A | * | 7/1998 | Mahlich | 239/552 |
| 5,862,960 | A | | 1/1999 | Miller et al. | |
| 5,875,934 | A | | 3/1999 | Miller et al. | |
| 5,890,661 | A | * | 4/1999 | Crampton et al. | 239/544 |
| 5,914,085 | A | * | 6/1999 | Zimmerhackel | 264/328.16 |
| 6,006,957 | A | | 12/1999 | Kunesh | |
| 6,086,812 | A | * | 7/2000 | Crampton et al. | 264/328.1 |
| 6,536,633 | B2 | * | 3/2003 | Stern et al. | 222/402.1 |
| 6,550,694 | B1 | | 4/2003 | Foster et al. | |

OTHER PUBLICATIONS

A—Two pages of photos showing a Bayer AG cap for an aerosol sprayer, the cap having two outlets that are parallel to each other and cut off at right angles to the axis of the outlets, admitted prior art.

B—One photo of a sprayer cap of Japanese origin, supplier unknown, admitted prior art.

C—A schematic sketch of a prior art nozzle similar to that of Exhibit A but where the outlets diverge.

* cited by examiner

*Primary Examiner*—Frederick Nicolas

(57) ABSTRACT

Nozzles are disclosed that are suitable for dispensing a liquid material to be dispensed from an aerosol can or other liquid reservoir. The nozzles are designed to deliver two streams of liquid which visually appear to substantially retain their separate character for a defined distance from the dispenser. The nozzles can have two parallel, horizontal, vertically aligned outlet paths, that are both truncated at their outer end at angles that are pointed away from each other.

16 Claims, 3 Drawing Sheets

SPRAY NOZZLE

CROSS-REFERENCE TO RELATED APPLICATIONS

Not applicable

STATEMENT REGARDING FEDERALLY SPONSORED RESEARCH/DEVELOPMENT

Not applicable

BACKGROUND OF THE INVENTION

The present invention relates to spray dispensing devices such as aerosol cans and hand held trigger pump sprayers. More particularly, it relates to nozzle outlet structures that permit such dispensers to provide at least two simultaneous spray streams which remain separate from each other for a desired distance from the dispenser.

It is often desirable to dispense a variety of chemicals in the form of liquid sprays. In an aerosol liquid spray system, one or more actives are typically mixed with a propellant and also solvent. Typical propellants are carbon dioxide, a hydrocarbon gas, or mixtures of hydrocarbon gases (such as a propane/butane mix). Typical solvents are water, hydrocarbon oils, and/or mixes thereof.

The active/propellant solvent mixture is stored under pressure in the aerosol can. The mixture is then sprayed out of the can by pushing down or sideways on an activator button at the top of the can that controls a release valve mounted in the top end of the can. The sprayed chemical may exit in an emulsion state, single phase, multiple phase, and/or be partially gaseous. Where any of what is sprayed is a liquid it is intended herein that the term "liquid material" will apply.

Without limitation, actives can include insect control agents (such as a repellent, insecticide, or growth regulator), fragrances, sanitizers, cleaners (such as surfactant containing materials), waxes or other surface treatments, deodorizers, and/or other compounds. Such actives may be for residential, business, agricultural, industrial, or other applications.

Pressure on an aerosol valve control stem can be provided by finger pressure on a button that is directly attached to the stem and has an internal passageway that leads can contents to an outlet on the side of the button. In response to actuation of the valve, the can contents are permitted to pass through to the outlet via the internal passageway, and thus there is created a spray that exits to the ambient environment. Alternatively, aerosol cans can be actuated by a combined over cap and actuator which provides an upper press pad connected by a living hinge to a skirt of the over cap. See e.g. U.S. Pat. No. 6,006,957.

It is sometimes desirable to directly aim an aerosol spray at a known desired small target. For example, a user may see a cockroach near a corner of a room at a location that is not easily reached by hand or foot, and desire to specifically aim the aerosol spray at it. However, in many other situations it is desirable to direct spray somewhat more broadly, such as when spraying a particular region for a prophylactic effect or cleaning. While there are a few other situations (e.g. fogging a room) where an essentially undirected spray may be desirable, in many circumstances there will be an optimal size for the spray pattern for a particular application.

Where a dispenser nozzle is fed from a single reservoir of chemical (the most typical case for aerosol cans), there are circumstances in which it is desirable to provide the consumer with the visual impression that the formulation contains multiple features. For example, an insect repellant spray might contain both a repellant material and a sunscreen material, and it could be desired to remind consumers that they are applying more than just a repellant when they spray. If the two actives are already mixed together in a single storage reservoir, it can therefore be desirable for the feed line from the single reservoir to be split into two outlet paths, with the paths then delivering two separate spray streams. This will provide a consumer with a reminder that the product contains more than just a single active. Also, this will provide a spray pattern that is somewhat wider, and therefore a pattern that has better area coverage than a more narrow spray system might have.

However, conventional two outlet sprayers either create too wide a spray pattern for certain applications, or are extremely bulky, or are difficult to manufacture. Others provide a spray pattern that collapses too quickly to be readily visually perceived as deriving from separate streams.

In other unrelated developments the art has provided a number of binary/two-part chemical dispensers. These systems store one chemical formulation in one reservoir and another chemical formulation in another reservoir. They are separately stored because the formulations are incompatible with each other for long-term storage (e.g. a dye in one formulation and a sensitive bleach in another; a carbonate in one formulation and an acid in another). See e.g. U.S. Pat. No. 6,550,694 (trigger pump sprayer).

Many of these binary pump systems permit these reservoirs to feed a common outlet within the spray dispenser so that mixing of the two formulations occurs within the dispenser. This can be disadvantageous because the separately stored chemicals can prematurely react, thereby causing clogging problems or disruption of the spray pattern, and in any event the consumer might not as easily appreciate the dual active nature of the product.

As a result, there have been a number of attempts to dispense formulations from two separate reservoirs in which the spray streams are directed to remain separate until outside the dispenser for some distance. See e.g. U.S. Pat. No. 5,005,536 for an aerosol system and U.S. Pat. No. 4,902,281 for a pump sprayer system. However, such systems are quite bulky (particularly at the outlet end), and are expensive to produce.

Even in those cases where the dispenser is more compact (e.g. the nozzle has two side-by-side adjacent outlets that parallel each other), the resulting spray streams have tended to collapse together only a very short distance from the dispenser.

Hence, the need still exists for improved nozzle assemblies, particularly those that can deliver two separate streams from a dispenser in an optimal way.

BRIEF SUMMARY OF THE INVENTION

The invention provides a nozzle for a spray dispenser, the nozzle being suitable to dispense a liquid material. There is a nozzle body having an inlet suitable to be positioned in communication with at least one reservoir having liquid material to be dispensed, an outlet end, and at least one conduit there between. The outlet end has two outlet pathways capable of being in communication with the inlet, the two outlet pathways each extending along its own longitudinal axis and having its own outer end.

At least the outer end of one of the outlet pathways is truncated at an angle that is non-perpendicular to the longitudinal axis of that outlet pathway adjacent that outer end, and the outer end of the other of the outlet pathways is truncated at an angle relative to its longitudinal axis adjacent its outer end which is different from the truncation angle for said first of the outlet pathways. For this purpose, a downward slope angle of a particular degree is considered different from an upward slope angle of even that same degree.

In any event, the longitudinal axis of a first of the two outlet pathways adjacent its outer end is essentially parallel to the longitudinal axis of the second of the two outlet pathways adjacent its outer end. This provides a very compact configuration.

In a particularly preferred embodiment, the outer end of the outlet pathway of a first of said outlet pathways is truncated at an angle that is non-perpendicular to the longitudinal axis of that outlet pathway adjacent that outer end, and the outer end of the other outlet pathway is also truncated at an angle that is non-perpendicular to its longitudinal axis adjacent its outer end. This is particularly desirable where one of the outlet pathways is positioned directly vertically above the second of the two outlet pathways. In this form one outlet pathway is configured to be able to direct spray at least partially downwardly as it exits the nozzle, and the other outlet pathway is configured so as to be able to direct spray at least partially upwardly as it exits the nozzle.

The spray dispenser may be an aerosol spray dispenser or a trigger pump spray dispenser (or as noted hereafter may take other forms). In the case of a trigger pump dispenser one alternative embodiment is where the nozzle body has its inlet end in communication with two of said conduits, one of said two conduits being linked to a first of said two outlet pathways and a second of said two conduits being linked to a second of said two outlet pathways.

It is most preferred that the nozzle body be part of a molded single piece plastic over cap, and the two longitudinal axes both extend essentially horizontally when the over cap is mounted in the normal manner on an aerosol can that is resting on a flat horizontal surface. Over caps of this type typically have a skirt suitable for linkage to an aerosol can, and in this case the nozzle body can be suitable to project spray out a radial side wall of the skirt.

Nozzles of the present invention can be used with a variety of liquid materials such as those containing insect control agents, fragrances, sanitizers, cleaners, waxes or other surface treatments, and/or deodorizers. Where the liquid material is all stored in a single storage reservoir, the nozzle body preferably is suitable to receive a formulation to be dispensed from that single reservoir and then split the formulation into two (or alternatively more) spray streams that exit the nozzle as separate streams.

On the other hand, where multiple storage reservoirs exist, the nozzle body can be suitable to receive a first formulation of liquid material from a first reservoir, receive a second formulation of liquid material different from the first from a second reservoir that is separate from the first reservoir, and then deliver the first formulation through the first outlet pathway and the second formulation separately through the second outlet pathway.

While the cross section of the outlet pathway need not necessarily be circular, that is highly preferred for providing more predictable spray characteristics. In such a case the first and second outlet pathways will be tubular. In any event it is highly preferred that the outlet pathways have cross sections that do not decrease in area adjacent the outer ends of the outlet pathways as liquid material approaches the outer ends of the outlet pathways.

In another aspect the invention provides a method of delivering a sprayable liquid material to be dispensed from a container to an ambient environment. One provides a container containing a sprayable material to be dispensed, the container having an exit. One then causes the sprayable material to pass through the exit and into a nozzle body of the above type to deliver two streams of liquid material out from said outlet pathways into the ambient environment. Preferably, the streams at least partially merge within one meter after the streams are emitted from the nozzle body. Preferably the streams also remain visually distinguishable for at least 5 cm (and preferably at least 15 cm and, even more preferable, at least 25 cm) after the streams are emitted from the nozzle body, even if neighboring portions of the streams have begun to be in contact with each other within that distance.

It will be appreciated from the above and the following description that the present invention provides a dual stream sprayer that keeps the spray streams separate for a visually appreciable distance. Yet, the spray streams will soon thereafter begin to collapse together. Thus, while the spray can be generally directed to a particular area the consumer will be able to appreciate that multiple spray streams have been ejected.

Further, the nozzle bodies (and actuator over caps incorporating them) can be inexpensively molded using automated equipment. Where the nozzle body is part of an over cap actuator, the over cap can be designed to be easily mounted on the can. Of course, the nozzle body need not be linked to an over cap. It may be directly placed on a valve stem in the form of a push button.

The foregoing and other advantages of various embodiments of the invention will be apparent from the following description. In the description reference is made to the accompanying drawings which form a part thereof, and in which there is shown by way of illustration preferred embodiments of the invention.

DETAILED DESCRIPTION OF THE PREFERRED EMBODIMENT

Figure 1:
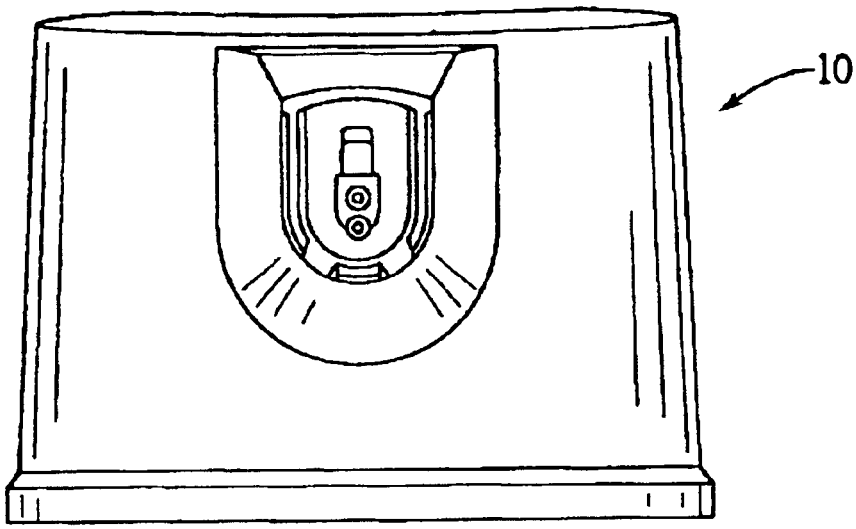
FIG. 1 is a frontal view of an actuator over cap embodying a nozzle body of the present invention.
Figure 3:
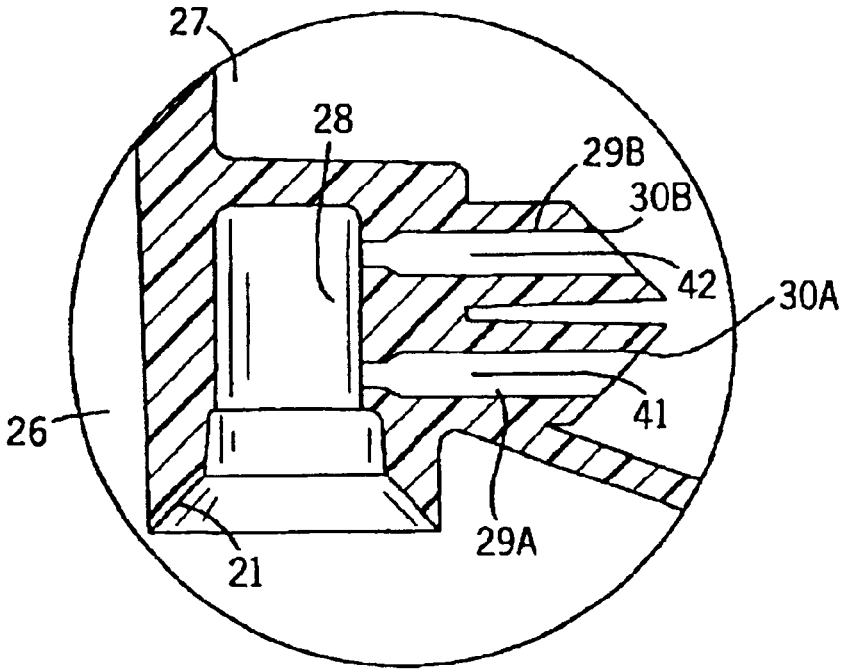
FIG. 3 is an enlarged depiction of the highlighted portion of FIG. 2.
Figure 2:
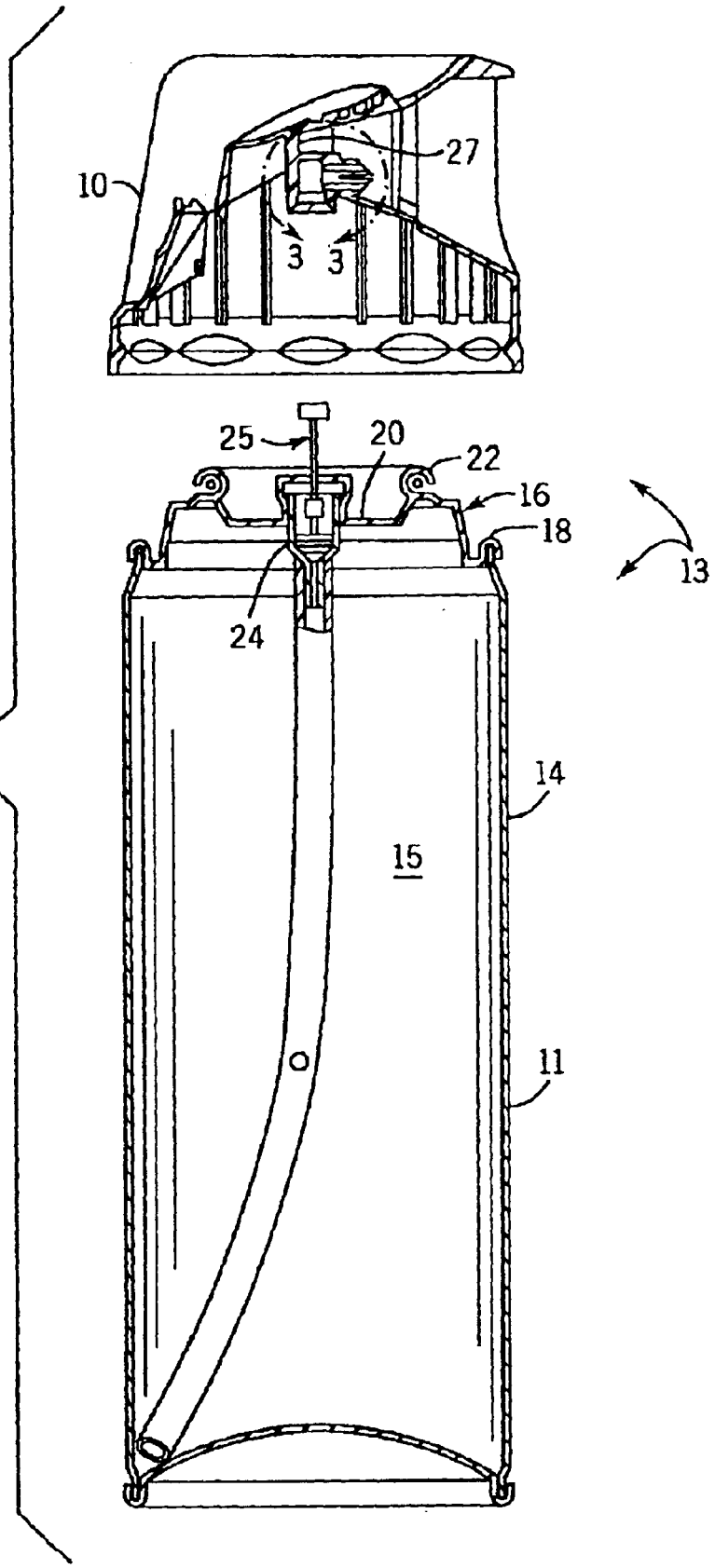
FIG. 2 is an exploded, partially vertical sectional, partially fragmented, view of the spray dispenser of FIG. 1, albeit associated with an aerosol can.

FIGS. 1–3 depict a first embodiment of the invention. There is an aerosol over cap 10 and a container 11, which together constitute an aerosol spray system 13. The container 11 can be a conventional aerosol metal (e.g. aluminum; steel) can. The container 11 defines an internal chamber 15 capable of housing a mixed liquid and gas material to be dispensed under pressure.

Container 11 includes a cylindrical outer wall 14 that is closed at its upper margin by the usual dome 16. The upper margin of the can wall 14 is joined to the dome via a can chime 18. An upwardly open valve cup 20 is located at the center of the dome 16 and is crimped or otherwise joined to the dome to form valve cup rim 22.

The aerosol system 13 includes a conventional aerosol valve 24 crimped to the valve cup 20. The aerosol valve 24 has a valve stem 25 that is hollow and extends axially up from the valve cup 20.

A variety of conventional aerosol valves are well known to the art (e.g. U.S. Pat. No. 5,068,099 and for environment U.S. Pat. No. 6,006,957). These valves are activated by moving their valve stems downwardly and/or sidewardly. Upon such activation, pressurized material to be dispensed that is contained within the container is delivered through the valve stem.

In the disclosed embodiment of the present invention, the actuator over cap 10 is mounted in cooperative relation to the valve stem 25. The entire over cap 10 is preferably molded from a resilient plastic such as polypropylene or polyethylene.

The FIG. 3 portion of the actuator over cap 10 is hereafter referred to as the nozzle body 26. It is linked to the remainder of the over cap by living hinge 27. The inlet 21 of the nozzle body is suitable to tightly receive the valve stem 25 extending from the can and to connect with a conduit 28 which branches sideways into outlet pathways 29A and B. This branching occurs even though the outlet pathways are fed from a single conduit 28 connectable to a single reservoir 15.

Figure 4:
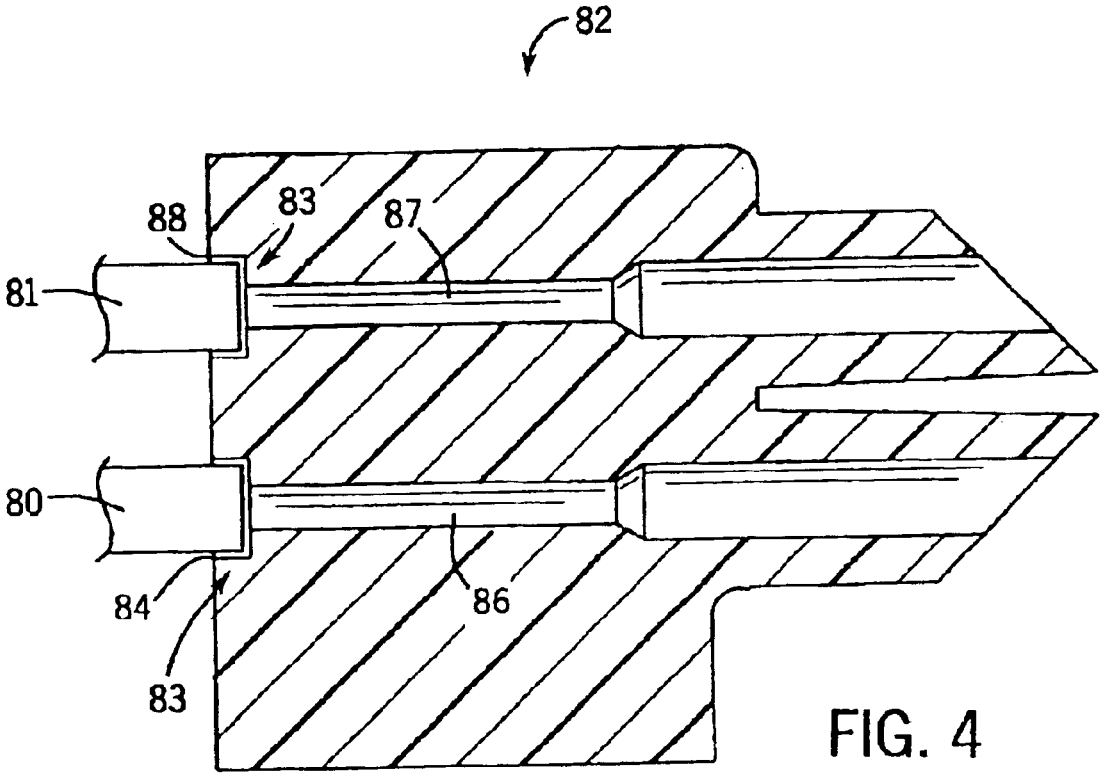
FIG. 4 is a schematic view, analogous to FIG. 3, but of a second embodiment of the present invention where a nozzle body of the present invention is incorporated into a trigger pump sprayer outlet.

Alternatively, as shown in FIG. 4, and as described in more detail below, the inlet could be formed as two separate passageways which separately connect to separate reservoirs and also separately to the separate outlet pathways. This would permit different, separately stored chemicals to remain separate until completely outside the dispenser.

Turning back to FIG. 3, the outlet pathways 29A and 29B extend to nozzle body outlet ends 30A and 30B. When the aerosol valve 24 is activated by pushing down on the actuator in a manner similar to the way the actuator of U.S. Pat. No. 6,006,957 can be pushed down, material to be dispensed is released to travel through the stem 25, then to the inlet 21, then to the conduit 28, and then out via the outlet pathways 29A and B.

The outlet pathways 29A and B extend essentially horizontally (defined by the position when the can is upright and the over cap is mounted on it). In any event, their longitudinal axes 41 and 42 extend in essentially parallel, vertically aligned, fashion.

It should particularly be noted that the outer ends 30A and 30B are truncated in a manner such that the pathways 29A and the pathway 29B can direct spray in diverging directions. Angles which are 35 degrees to 55 degrees from vertical are preferred. Note also that the pathways 29A and 29B do not decrease in cross sectional area as the liquid material approaches the outer ends 30A and 30B. This helps insure vigorous spray.

A spray stream emitted via pathway 29A will quickly angle downwardly, with essentially no upward vector. On the other hand, a stream emitted from pathway 29B will first flow outward as well as upward, with very little if any initial spray going downward for some distance. Thus, the streams will initially appear to a consumer to be separate.

These streams will preferably remain visually distinguishable from each other for at least about 5 and preferably at least 15 cm and, even more preferable, at least about 25 cm away from the can, even if neighboring portions of the streams have begun to be in contact with each other within that distance. Thereafter, the flows will begin to converge. This gives the consumer an indication that two separate attributes are present (regardless of whether deriving from one or two stored formulations), while still permitting area targeting by the spray.

Because the pathways 29A and 29B have a straight line structure near their outer end, molding them is relatively easy. Further, because they are parallel they are compactly positionable so as to provide more room in any given over cap space for other desired features.

The nozzle body 26 provides multiple desired functions. It provides a way to cause a release of material from the container, provides a means of securely linking a nozzle to the valve stem, and it provides a nozzle structure for controlling stream delivery.

Container 11 can be charged with any conventional, sprayable liquid formulation, including but not limited to insect control, cleaning, disinfecting, or air scent or quality modifying materials. Of course, many other known types of sprayable liquid materials could be used instead.

FIG. 4 depicts in schematic form how a nozzle body of the present invention could be incorporated with a dual reservoir system, such as one that might be found in a trigger pump sprayer like that of U.S. Pat. No. 6,550,694. Feed lines 80 and 81 carry pumped fluids motivated by a pump trigger to feed into an alternative nozzle body (generally 82). The body has an inlet region 83 with two separate receiving channels 84 and 85 that receive liquid from lines 80 and 81. These receiving channels are in communication with conduit sections 86 and 87, which in turn are connected to a nozzle body outlet portion very much like that of FIG. 3. This sprayer will operate much as the FIG. 1 sprayer apart from what motivates the fluid, and except that the expelled separate streams derive from separately stored materials, rather than a single source.

The above description and the associated drawings merely disclose preferred embodiments of the present invention. Still other modifications may be made without departing from the spirit and scope of the invention. For example, a variety of other pumping and delivery systems are also possible (e.g. electrical pumps; gravity-fed systems).

Also, while the truncation angles are formed by straight line cuts in the preferred embodiments, the truncation angles could be formed by curved or other ends. Still other variations on the structure are possible within the spirit and scope of the invention. Thus, the invention is not to be limited to just the preferred embodiments described above and/or disclosed in the accompanying drawings. Rather, the claims should also be looked to in order to judge the full scope of the invention.

INDUSTRIAL APPLICABILITY

The present invention provides nozzles useful in delivering a liquid spray in at least two streams which appear substantially separate as they exit the nozzle, and methods for using such nozzles.

We claim:

1. A nozzle for a spray dispenser, the nozzle being suitable to dispense an at least partially liquid material, the nozzle comprising:

a nozzle body having an inlet suitable to be positioned in communication with at least one reservoir having liquid material to be dispensed, an outlet end, and at least one conduit there between;

the outlet end having two outlet pathways capable of being in communication with the inlet, each of said two outlet pathways extending along its own longitudinal axis and having its own outer end;

the outer end of one of the outlet pathways being truncated at an angle that is between 35 degrees to 55 degrees from vertical and non-perpendicular to the longitudinal axis of that outlet pathway adjacent that outer end, and the outer end of the other of the outlet pathways being truncated at an angle relative to its longitudinal axis adjacent its outer end which is different from the truncation angle for said first of said outlet pathways;

wherein the longitudinal axis of a first of said two outlet pathways adjacent its outer end is essentially parallel to the longitudinal axis of the second of said two outlet pathways adjacent its outer end.

2. The nozzle of claim 1, wherein the outer end of said other of the outlet pathways is also truncated at an angle which is 35 degrees to 55 degrees from vertical, whereby the outer ends of said outlet pathways can direct spray in diverging directions.

3. The nozzle of claim 2, wherein a first of said two outlet pathways is positioned vertically above a second of said two outlet pathways.

4. The nozzle of claim 3, wherein the second of said two outlet pathways is configured to be able to direct spray at least partially downwardly as it exits the nozzle, and the first of said two outlet pathways is configured so as to be able to direct spray at least partially upwardly as it exits the nozzle.

5. The nozzle of claim 1, wherein the spray dispenser is an aerosol spray dispenser.

6. The nozzle of claim 1, wherein the nozzle body has its inlet end in communication with two of said conduits, one of said two conduits being linked to a first of said two outlet pathways and a second of said two conduits being linked to a second of said two outlet pathways.

7. The nozzle of claim 1, wherein the nozzle body is a molded single piece plastic structure.

8. The nozzle of claim 1, wherein the nozzle body is a portion of an actuator over cap for an aerosol spray dispenser, wherein the over cap has a skirt suitable for linkage to an aerosol can, and the nozzle body is suitable to project spray out a radial side wall of the skirt.

9. The nozzle of claim 1, wherein the liquid material comprises an active selected from the group consisting of insect control agents, fragrances, sanitizers, cleaners, waxes or other surface treatments, and/or deodorizers.

10. The nozzle of claim 1, wherein the nozzle body is suitable to receive a formulation to be dispensed from a single reservoir and then split the formulation into two spray streams that exit the nozzle as separate streams.

11. The nozzle of claim 1, wherein the first and second outlet pathways are tubular and each has perpendicular transverse cross sections through a flow path through the tubular pathway that do not decrease in size adjacent the outer end of the outlet pathway as liquid material approaches the outer end of the outlet pathway.

12. A method of delivering a sprayable liquid material to be dispensed from a container to an ambient environment, the method comprising the steps of:

(a) providing a container containing a sprayable material to be dispensed, the container having an exit;

(b) then causing the sprayable material to pass through the exit and into a nozzle body of claim 1; and (c) then delivering two streams of liquid material out from said outlet pathways into the ambient environment.

13. The method of claim 12, wherein within one meter after the streams are emitted from the nozzle body they at least partially merge.

14. The method of claim 13, wherein the streams remain visually distinguishable for at least 5 cm after the streams are emitted from the nozzle body, even if neighboring portions of the streams have begun to be in contact with each other within that distance.

15. The method of claim 14, wherein the streams remain visually distinguishable for at least 15 cm after the streams are emitted from the nozzle body, even if neighboring portions of the streams have begun to be in contact with each other within that distance.

16. The method of claim 14, wherein the streams remain visually distinguishable for at least 25 cm after the streams are emitted from the nozzle body, even if neighboring portions of the streams have begun to be in contact with each other within that distance.

* * * * *